US006062186A

United States Patent [19]

Barnes et al.

[11] Patent Number: 6,062,186

[45] Date of Patent: May 16, 2000

[54] METHOD OF STARTING AN ENGINE

[75] Inventors: Travis E. Barnes, Peoria; David J. Beatty, Bloomington; William H. Lane, Chillicothe; Alan R. Stockner, Metamora, all of Ill.

[73] Assignee: Caterpillar Inc., Peoria, Ill.

[21] Appl. No.: 08/995,776

[22] Filed: Dec. 22, 1997

[51] Int. Cl.[7] ..... F02N 9/00; F02N 17/00

[52] U.S. Cl. ..... 123/179.3; 123/179.6; 123/179.16

[58] Field of Search ..... 123/179.6, 179.5, 123/179.3, 179.21, 179.16, 179.18

[56] References Cited

U.S. PATENT DOCUMENTS

| | | | |
|---|---|---|---|
| 4,009,695 | 3/1977 | Ule | 123/90.13 |
| 4,205,650 | 6/1980 | Szwarchier | 123/146.5 A |
| 5,469,819 | 11/1995 | Berger et al. | 123/179.6 |
| 5,687,682 | 11/1997 | Rembold et al. | 123/179.3 |

FOREIGN PATENT DOCUMENTS

| | | |
|---|---|---|
| 3117144A1 | 11/1982 | Germany . |
| 4200606A1 | 7/1993 | Germany . |
| 58-148223 | 3/1983 | Japan . |
| 2104969 | 8/1982 | United Kingdom . |
| 93/04278 | 3/1993 | WIPO . |

*Primary Examiner*—Tony M. Argenbright
*Assistant Examiner*—Arnold Castro
*Attorney, Agent, or Firm*—Larry G. Cain

[57] ABSTRACT

Past methods for starting an engine have included increasing the amount of fuel to support combustion creating an excess of unburned fuel in the exhaust causing white smoke. Such past methods for starting an engine additionally required additional components, such as heater, and required an excessive draw on the battery to provide extensive glow plug operation and extensive cranking. The present method of starting an engine reduces and essentially eliminates white smoke, reduces the need for extensive glow plug operation and reduces the need for extensive cranking. The method of starting an engine includes the steps of: positioning an intake valve in a closed position; positioning an exhaust valve in a closed position; rotating a piston to a top dead center position; rotating the piston from the top dead center position toward a bottom dead center position; and injecting a fuel into the cylinder.

14 Claims, 3 Drawing Sheets

METHOD OF STARTING AN ENGINE

TECHNICAL FIELD

This invention relates generally to an engines and more particularly to a method for starting an engine.

BACKGROUND ART

The use of fossil fuel as the combustible fuel in engines results in the combustion products of carbon monoxide, carbon dioxide, water vapor, smoke and particulate, unburned hydrocarbons, nitrogen oxides and sulfur oxides. Of these above products carbon dioxide and water vapor are considered normal and unobjectionable. In most applications, governmental imposed regulations are restricting the amount of pollutants being emitted in the exhaust gases. Additionally, during start-up, many engines, create white smoke which is considered a nuisance.

During the starting mode and especially during cold starting, past practice has been to apply current from the battery to the glow plugs for a given period of time and increase the amount of fuel during initial cranking of the engine. This practice results in drainage of the battery, poor mixing, incomplete burning and excess white smoke being emitted from the combustion chamber. As the heat of combustion increases, the efficiency of mixing fuel and air increases and the amount of white smoke is reduced and eventually eliminated.

Attempts to reduce white smoke and increase starting efficiencies include the use of external starting aids. These starting aids have included combustion aids, such as, ether starting aids and/or intake air heater. When using the above aids, the normal procedure for starting also includes a provision to increase the amount of fuel supplied to the combustion chamber. This increase of fuel supplied to the combustion chamber many time exceeds the amount of fueling for rated engine power by up to 25 percent. This is traditionally necessary since combustion is very poor at starting conditions, and only a portion of the fuel is burned. The reminder of the fuel is not burned, and is seen as excessive white smoke. Thus, these starting methods contribute to excess fuel consumption.

The present invention is directed to overcoming one or more of the problems as set forth above.

DISCLOSURE OF THE INVENTION

In one aspect of the invention a method of starting an engine is disclosed. The engine includes a head having an intake valve being movable between an open position and a closed position and an exhaust valve being movable between an open position and a closed position. A block is attached to the head. The block includes a cylinder positioned therein and a crankshaft is rotatably positioned therein. A piston having a re-entry portion is positioned within the cylinder and a connecting rod connects the piston to the crankshaft. During rotation of the crankshaft the piston is movable between a top dead center position and a bottom dead center position. A fuel injector is operatively positioned in the engine and supplies a fuel to the cylinder. The method of starting includes the step of: positioning the intake valve in the closed position, positioning the exhaust valve in the closed position, rotating the piston to the top dead center position, rotating the piston from the top dead center position toward the bottom dead center position, and injecting a fuel into the cylinder.

In another aspect of the invention, a method of starting an engine is disclosed. The engine includes a head having an intake valve being movable between an open position and a closed position and an exhaust valve being movable between an open position and a closed position. A block is attached to the head. The block includes a cylinder positioned therein and a crankshaft being rotatably positioned therein. A sensor operatively senses the rotation of the crankshaft. A controller is in operative communication with the sensor. A piston having a re-entry portion is positioned within the cylinder and a connecting rod connects the piston to the crankshaft. During rotation of the crankshaft the piston is movable between a top dead center position and a bottom dead center position. And, a fuel injector is operatively positioned in the engine and connects a supply of a fuel to the cylinder. The fuel injector is operatively connected to the controller. The method of starting includes the step of: positioning the intake valve in the closed position; positioning the exhaust valve in the closed position; sensing the position of the crankshaft; sending a signal to the controller; rotating the piston to the top dead center position; rotating the piston from the top dead center position toward the bottom dead center position; sending a signal to the fuel injector; and injecting the fuel into the cylinder.

BEST MODE FOR CARRYING OUT THE INVENTION

Figure 1:
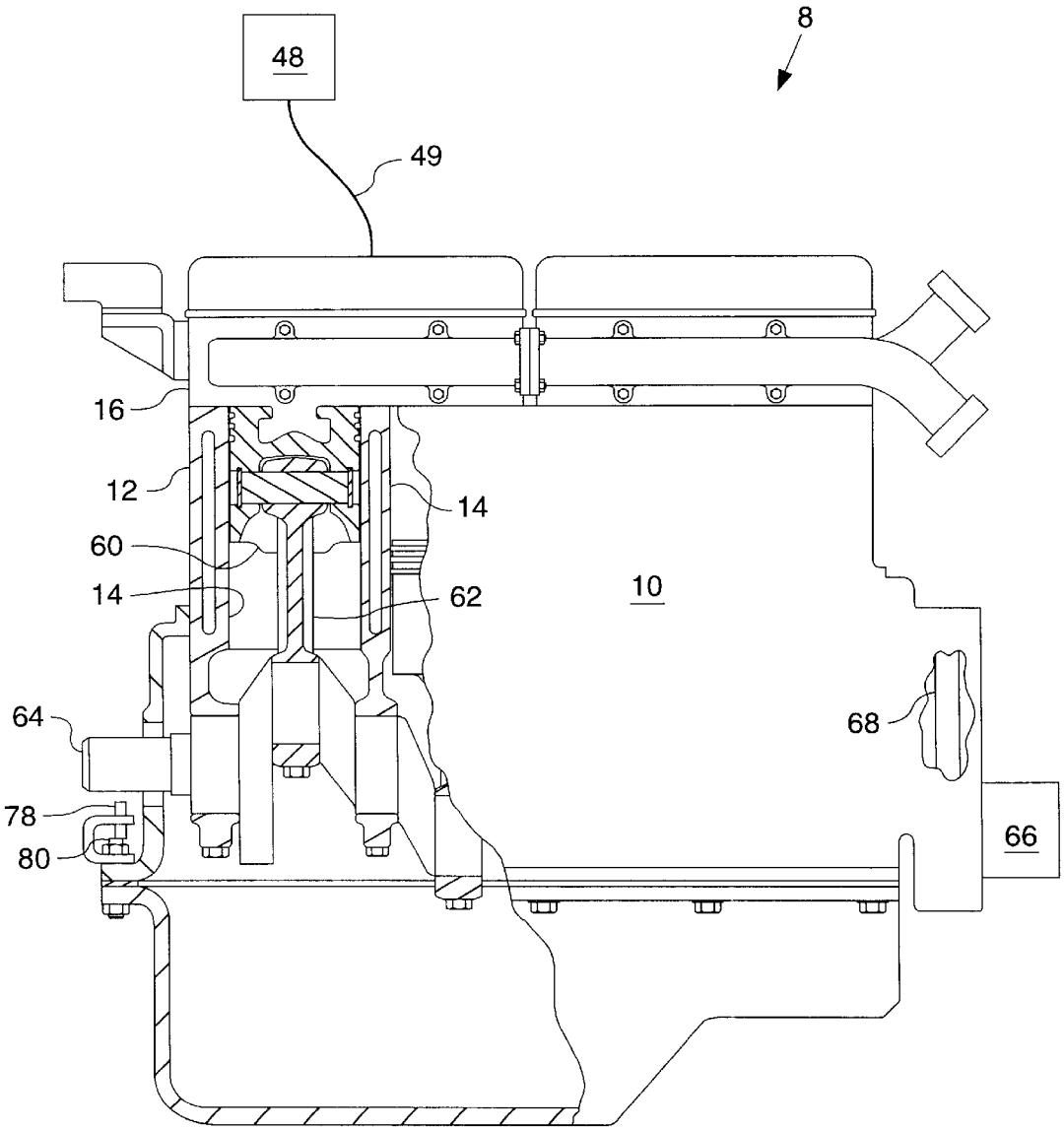
FIG. 1 is a sectional view of a portion of an internal combustion engine embodying the starting method.
Figure 2:
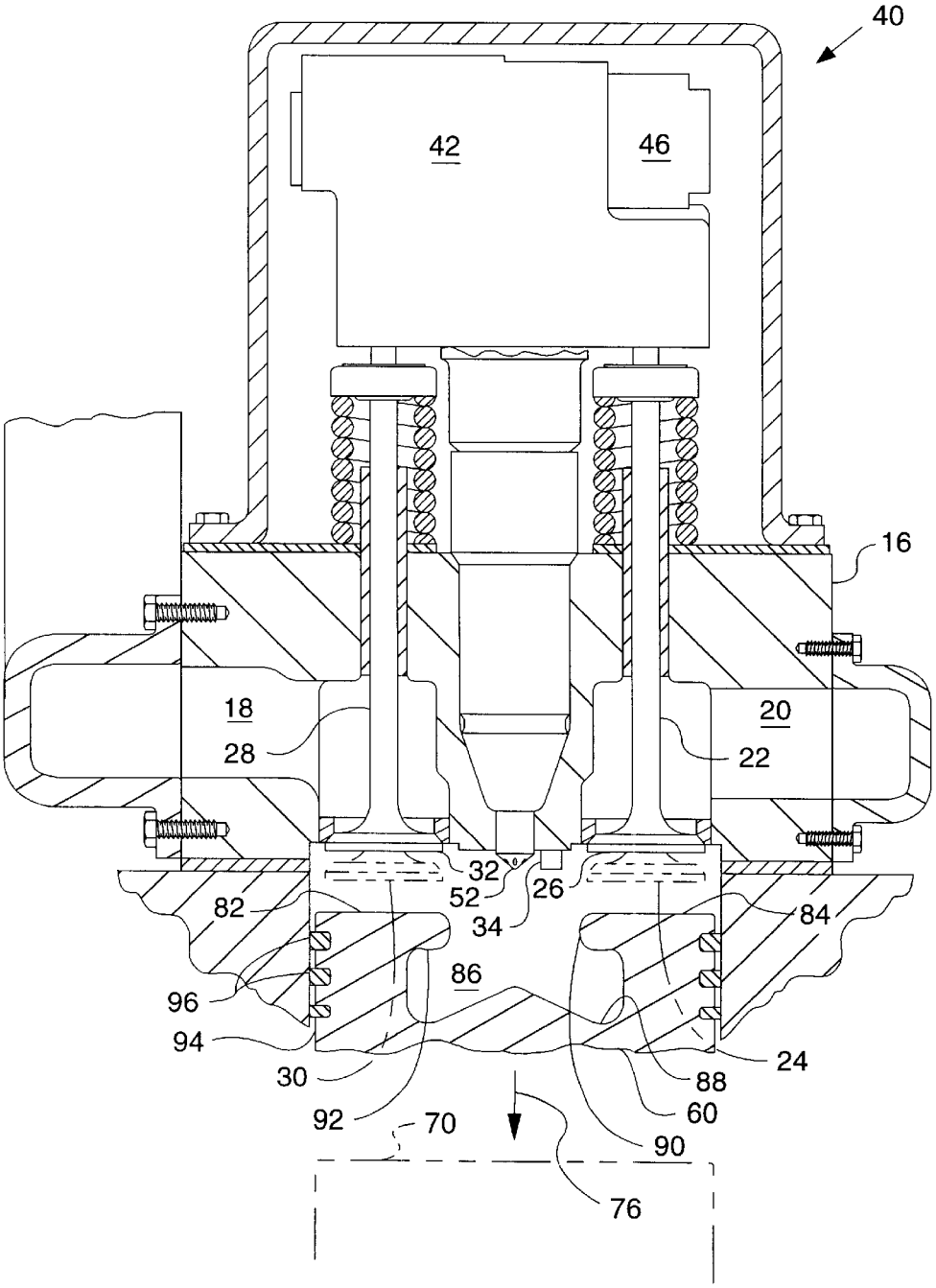
FIG. 2 is an enlarged sectional view of a portion of an internal combustion engine embodying the starting method.
Figure 3:
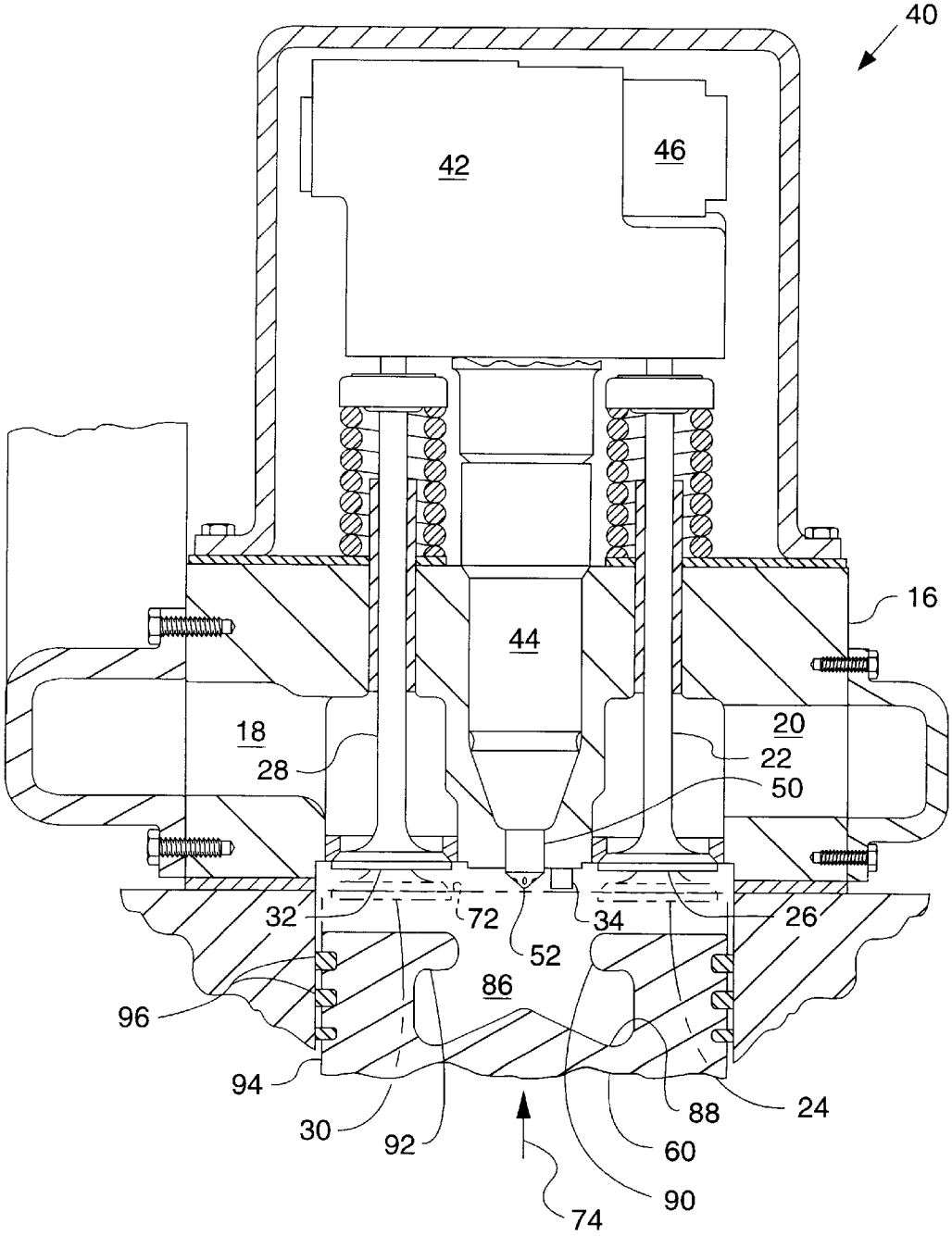
FIG. 3 is an enlarged sectional view of a portion of an internal combustion engine embodying the starting method.

Referring to FIG. 1, a method 8 of starting an engine 10 is disclosed. In this application, the engine 10 is a four stroke or cycle engine, but could be of an alternative cycle, such as a two cycle, without changing the essence of the invention. The four strokes or cycles include an intake stroke, a compression stroke, a power stroke and an exhaust stroke. The engine 10 includes a block 12 having a plurality of cylinder 14 therein. A head 16 is attached to the block 12 in a conventional manner. As best shown in FIGS. 2 and 3, the head 16 includes an exhaust passage 18 and an intake passage 20 defined therein. An intake valve 22 is interposed the intake passage 20 and the respective one of the plurality of cylinders 14. The intake valve 22 operatively moves between an open position 24, as shown in phantom, and a closed position 26. An exhaust valve 28 is interposed the exhaust passage 18 and the respective one of the plurality of cylinders 14. The exhaust valve 28 operatively moves between an open position 30, as shown in phantom, and a closed position 32. Also positioned in the head 16 and extending into a respective one of the plurality of cylinders 14 is a glow plug 34 being of convention construction and operation. As an alternative, other heating systems not shown, such as an either starting or an air heating system could be incorporated without changing the essence of the invention.

As further shown in FIGS. 2 and 3, a fuel system 40 is provided for each one of the plurality of cylinders 14. The fuel system 40 includes an actuation device 42 and a fuel injector 44 for each of the plurality of cylinders 14. In this application, the actuation device 42 is defined by an electrical device 46 being connected to a controller 48 by a plurality of wires 49, best shown in FIG. 1. The controller 48 sends a signal to the fuel injector 44 of the respective one of the plurality of cylinders 14 and a fuel is injected into the appropriate cylinder 14. But, as an alternative, the actuation device 42 could include any convention system such as a mechanical device or another conventional device. The fuel injector 44 is removably attached within the head 16. Each of the fuel injectors 44 has a tip 50 extending into a respective one of the plurality of cylinders 14. A supply of the fuel, not shown, is communicated to each fuel injector 44. Each of fuel injector 44 has a passage 52 positioned within the tip 50 through which fuel is injected into the respective one of the plurality of cylinders 14. In this application, a plurality of passages 52 are positioned within the tip 50.

Positioned within each of the plurality of cylinders 14 is a piston 60. As best shown in FIG. 1, the piston 60 is attached to a connecting rod 62 being attached to a crankshaft 64. The crankshaft 64 is rotatably positioned within the block 12. During starting, a starter 66 rotates a flywheel 68 being attached to the crankshaft 64 in a conventional manner. And, as the crankshaft 64 rotates, the piston 60 is moved between a bottom dead center position 70, as shown in phantom in FIG. 2, and a top dead center position 72, as shown in phantom in FIG. 3, through the four strokes described above. As best shown in FIG. 3 and indicated by an arrow 74, the piston 60 is moving toward the top dead center position 72 in the compression stroke. As best shown in FIG. 2 and indicated by an arrow 76, the piston 60 is moving after the top dead center position 72 toward bottom dead center position 70. A sensor 78 is mounted on the block 12 and monitors the rotational position of the crankshaft 64 relative to top dead center position 72 and bottom dead center position 70 of the respective cycle or stroke. Thus, the position of the crankshaft 64 at any rotational angle is communicated by a signal to the controller 48 by a plurality of wires 80.

The piston 60, in this application, has a preestablished configuration. For example, the piston 60 includes a head portion 82 defining a top face 84. A recessed portion 86 is positioned within the head portion 82 and extend a preestablished distance from the top face 84 defining a bottom portion 88. The recessed portion 86 includes a protrusion member 90 positioned near the top face 84. The recessed portion 86 defines a re-entry portion 92 interposed the protrusion member 90 and the bottom portion 88. The piston 60 further includes a skirt portion 94 extending from the top surface 84 and has a plurality of rings 96 positioned therein in a conventional manner.

Industrial Applicability

In operation, the crankshaft 64 of the engine 10 is rotated by activating the starter 66. This results in the piston 60 moving between the top dead center position 72 and the bottom dead center position 70 and through the four strokes or cycles. The sensor 78 monitors the rotational position of the crankshaft 64 and sends a signal to the controller 48. The controller 48 interprets the signal and at the proper interval, relative to the rotational position of the crankshaft 64 and the piston 60, sends a signal to the fuel injector 44 of the appropriate one of the plurality of cylinders 14 to inject the fuel into the cylinder 14. For example, in the four cycle engine, the following engine condition exist. The respective one of the plurality of cylinders 14 has just completed the compression stroke, from the bottom dead center position 70 to the top dead center position 72. And, the respective intake and exhaust valves 22,28 are in the closed position 26,32. And, the respective piston 60 within the one of the plurality of cylinders 14 has just moved into the power stroke, and the fuel is introduce into the respective one of the plurality of cylinders 14. Thus, the piston 60 is moving from the top dead center position 72 toward the bottom dead center position 70 in the power stroke. Experimentation has shown that under these parameters, better mixing of the fuel and air is accomplished. Additionally, less fuel than the conventional or normal amount of fuel can be injected in the respective one of the plurality of cylinders 14. This results in less unburned fuel being emitted to the exhaust resulting in little or no white smoke. Furthermore, the position of the piston 60 at the time the fuel is injected into the respective one of the plurality of cylinders 14 will be in a range of from at the top dead center position 72 or 0 degrees to a position below the top dead center position 72 of about 15 degrees during the power stroke. Ideally, injection of the fuel is at about 5 degrees below the top dead center position during the power stroke.

Thus, the method 8 of starting an engine 10 resulting in little or no white smoke is accomplished. The engine 10 is started more quickly than past conventional starting methods when using this new method 8 of starting the engine 10. The starting method 8 results a lower quantity of the fuel being required. The engine 10 will start with reduced glow plug wait times and/or at a lower temperature (warm-up times). And, the engine 10 starting method 8 overcomes adverse condition such as a weak battery since the glow plug 34 waiting time is reduced and the cranking time is reduced.

What is claimed is:

1. A method of starting a compression ignition engine, said engine including a head having an intake valve being movable between an open position and a closed position and an exhaust valve being movable between an open position and a closed position, a block being attached to said head, said block including a cylinder positioned therein and a crankshaft being rotatably positioned therein, a piston being positioned within said cylinder and a connecting rod connecting said piston to said crankshaft, during rotation of said crankshaft said piston being movable between a top dead center position and a bottom dead center position, and a fuel injector being operatively positioned in said engine and supplying a fuel to said cylinder; said method of starting including the steps of:

filling said cylinder with an air;

positioning said intake valve in said closed position;

positioning said exhaust valve in said closed position;

actuating a starter and rotating said crankshaft resulting in rotating said piston to said top dead center position;

continuing to actuate said starter and further rotating said piston from said top dead center position toward said bottom dead center position;

injecting a fuel into said cylinder, said cylinder including said piston being at a position after said top dead center position in the range of from about 0 degrees to 15 degrees;

mixing said fuel and said air; and combusting said mixed fuel and air during said rotation of said piston from said top dead center position toward said bottom dead center position.

2. The method of starting an engine of claim 1, wherein said step of rotating said piston from said top dead center position toward said bottom dead center position includes said engine being a four stroke engine and said step being at a power stroke.

3. The method of starting an engine of claim 1, wherein said step of positioning said intake valve in said closed position includes said engine being a four stroke engine and said closed position continues during a power stroke.

4. The method of starting an engine of claim 1, wherein said step of positioning said exhaust valve in said closed position includes said engine being a four stroke engine and said closed position continues during a power stroke.

5. The method of starting an engine of claim 1, wherein said step of injecting a fuel into said cylinder includes said engine being a four stroke engine and said step being at a power stroke.

6. The method of starting an engine of claim 1 wherein said step of injecting a fuel into said cylinder includes said piston being at a position after said top dead center position at about 5 degrees.

7. The method of starting an engine of claim 1, further including the step of actuating a glow plug.

8. The method of starting an engine of claim 1, wherein said piston having a re-entry portion.

9. A method of starting a compression ignition engine, said engine including a head having an intake valve being movable between an open position and a closed position and an exhaust valve being movable between an open position and a closed position, a block being attached to said head, said block including a cylinder positioned therein and a crankshaft being rotatably positioned therein, a sensor operatively sensing rotation of said crankshaft, a controller being in operative communication with said sensor, a piston being positioned within said cylinder and a connecting rod connecting said piston to said crankshaft, during rotation of said crankshaft said piston being movable between a top dead center position and a bottom dead center position, and a fuel injector being operatively positioned in said engine and connecting a supply of a fuel to said cylinder, said fuel injector being operatively connected to said controller; said method of starting including the steps of:

filling said cylinder with an air;

positioning said intake valve in said closed position;

positioning said exhaust valve in said closed position;

sensing said position of said crankshaft;

sending a signal to said controller;

rotating said piston to said top dead center position;

continuing said rotating of said piston from said top dead center position toward said bottom dead center position;

sending a signal to said fuel injector;

injecting said fuel into said cylinder, said cylinder including said piston being at a position after said top dead center position in the range of from about 0 degrees to 15 degrees;

mixing said fuel and said air; and combusting said mixed fuel and air during said rotation of said piston from said top dead center position toward said bottom dead center position.

10. The method of starting an engine of claim 9, wherein said step of rotating said piston from said top dead center position toward said bottom dead center position includes said engine being a four stroke engine and said step being at a power stroke.

11. The method of starting an engine of claim 9, wherein said step of injecting a fuel into said cylinder includes said engine being a four stroke engine and said step being at a power stroke.

12. The method of starting an engine of claim 9, wherein said step of injecting a fuel into said cylinder includes said piston being at a position after said top dead center position at about 5 degrees.

13. The method of starting an engine of claim 9, further including the step of actuating a glow plug.

14. The method of starting an engine of claim 9, wherein said piston having a re-entry portion.

* * * * *